United States Patent [19]

Zocher

[11] 3,954,072

[45] May 4, 1976

[54] NEEDLES FOR TUFTING OR THE LIKE

[75] Inventor: Josef Zocher, Harren, Aachen, Germany

[73] Assignee: The Singer Company, New York, N.Y.

[22] Filed: May 28, 1975

[21] Appl. No.: 581,598

[52] U.S. Cl. ..... 112/222

[51] Int. Cl.[2] ..... D05B 85/00

[58] Field of Search..... 112/222, 223, 225, 79 R

[56] References Cited

UNITED STATES PATENTS

| | | | |
|---|---|---|---|
| 360,884 | 4/1887 | Hutchinson | 112/222 |
| 3,469,548 | 9/1969 | Zocher | 112/222 |
| 3,862,611 | 1/1975 | Kuromegawa | 112/222 |

*Primary Examiner*—H. Hampton Hunter
*Attorney, Agent, or Firm*—Edward L. Bell; Robert E. Smith; Alan Ruderman

[57] ABSTRACT

A tufting needle construction in which the axis of the eye and point portion of the needle is parallel but offset relative to the axis of the needle and the blade of the needle just above the needle eye is parallel but offset relative to the eye and point portion to form the clearance above the eye portion of the needle. The axis of the eye and point portion passes into the clearance above the eye. The construction is such that the cross section of the needle at the eye is less than that of known needles of similar gauge and the clearance above the eye may be equal to or greater than that of such known needles.

7 Claims, 10 Drawing Figures

10
12
14
16
18
20
22
24
26
30
32
34
36
38
40
42
44
B
Y
α
β
5
6
7
8
9

NEEDLES FOR TUFTING OR THE LIKE

BACKGROUND OF THE INVENTION

This invention relates to tufting needles and more particularly to improved needles of this type in which the cross section at the eye is reduced while the looper receiving clearance above the eye is maintained sufficiently large for safe loop seizure.

The art of tufting incorporates needles for piercing a backing fabric to insert loops of yarn into the backing. The penetration forces required to pass the needle through the backing is an important factor in limiting the working speed of the tufting machine due to the vibration effects and the influence on wear life of the parts of the machine and the needles themselves. It is desirable to use tufting needles having relatively large needle eye openings due to the use of heavy yarns and also since the yarns vary in bulkiness and the practice of connecting yarn from a plurality of yarn cones together. However, the penetration force of the needles is related to the cross section of the needle at the eye which determines the size of the penetration hole made in the backing fabric. The individual hole size and the needle spacing or gauge moreover determines the reduction in tensile strength of the backing material. Furthermore, the needle cross section affects the machine gauge since each needle requires a defined space to penetrate through the needle plate fingers.

The requirement of a large needle eye with a small cross section has not been satisfactorily attained with the known prior art needles. One thing that has prevented this is that normally the looper must pick up a loop of yarn when the yarn is under tension, i.e., the looper picks up a loop while the needle is on the down stroke. This is a necessity if continuous filament yarn is being tufted, especially for gauges below 5/32 inch. For this reason tufting needles are designed with a clearance above the eye (C.A.E.) within which the looper passes to pick up a loop. In certain limited instances when using some spun yarn, the yarn is allowed to bloom to form a loop which is picked up on the needle up stroke. However, even in these limited instances the blooming is minimal and a clearance is required. The prior art needles, in order to realize the required clearance, increase the needle thickness at the eye to provide a kick-out or step at the web between the eye and the blade. This results in a clearance space between the needle and the adjacent yarn leg within which the looper passes. The depth of the kick-out and the clearance above the eye determines the thickness of the needle side wall at the eye, and thus, the cross section of the penetration hole.

SUMMARY OF THE INVENTION

Essentially the invention provides a tufting needle in which the axis of the eye and point portion is parallel to but offset relative to the axis of the needle and the clearance above the eye portion of the blade is parallel to but offset relative to the eye and point portion. By offsetting or "cranking" the clearance above the eye portion of the blade relative to the eye and point portion, the C.A.E. can be large while keeping the point and eye thin relative to conventional needles. Thus, the cross section of the needle at the eye can be reduced to provide reductions in the penetration forces.

Accordingly, it is the primary object of the present invention to provide a tufting needle having a reduced cross section at the eye while maintaining or improving the ability of the needle to transfer a loop of yarn to a looper.

It is another object of this invention to provide a tufting needle wherein the penetration force through the backing fabric is reduced and the degree of distortion of the backing is also reduced.

It is a further object of this invention to provide a tufting needle wherein the penetration force through the backing fabric is reduced and which needle has improved yarn transfer capabilities.

My co-pending U.S. Pat. No. 3,929,082, dated Dec. 30, 1975 proposes one solution which meets these objectives by providing a needle construction in which the eye and point portion of the needle is skewed at an angle to the longitudinal axis of the needle away from the needle yarn guide groove so that the eye and point portion can be of a reduced thickness relative to conventional needles to reduce the penetration forces, and the C.A.E. can be sufficiently large for good loop seizure. The present invention provides another construction in which the penetration forces are reduced while improving loop transfer. This construction offsets, but does not skew, the eye and point portion relative to the needle center line.

It is, therefore, a more specific object of the present invention to provide a tufting needle in which the eye and point portion of the needle is parallel to but offset relative to the needle axis and the clearance above the eye portion of the blade is parallel to but offset relative to the eye and point portion.

BRIEF DESCRIPTION OF THE DRAWINGS

Other objects and advantages of this invention will best be understood upon reading the following description of the invention together with the accompanying drawings in which.

DETAILED DESCRIPTION OF THE INVENTION

Figures 1, 2, 3, 4, 5, 6, 7, 8, 9, 10:
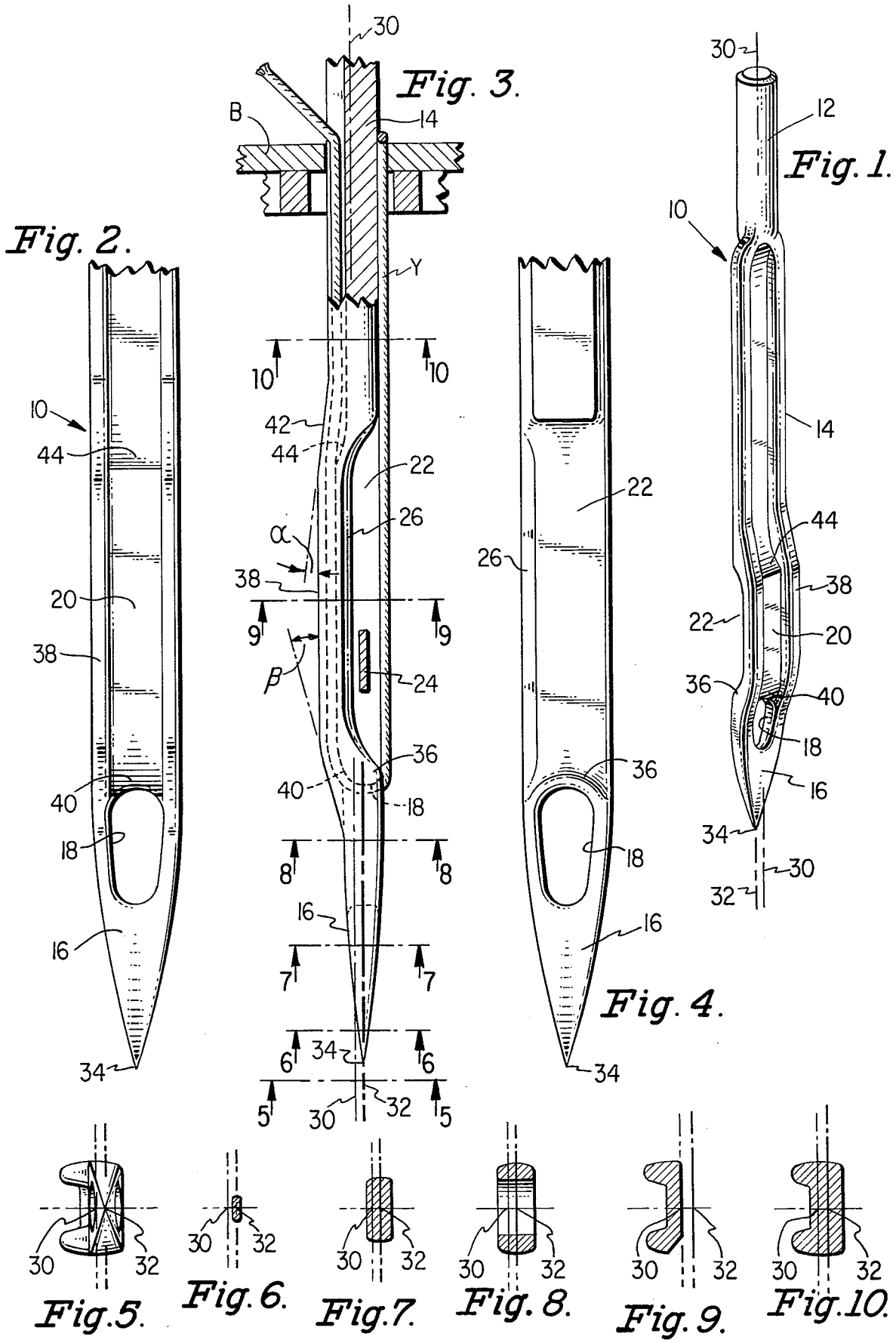
FIG. 1 is a perspective view of a needle constructed in accordance with the principles of the present invention.
FIG. 2 is a fragmentary front elevational view of the needle illustrated in FIG. 1.
FIG. 3 is a partial side elevational view of the needle illustrated in FIG. 1 shown at the bottom of its stroke in a tufting machine illustrating the looper within the clearance above the eye.
FIG. 4 is a fragmentary rear elevational view of the needle of FIG. 1.
FIG. 5 is an end elevational view of the needle of FIG. 1 viewed from the point.
FIG. 6 is a cross sectional view taken substantially along line 6—6 of FIG. 3.
FIG. 7 is a cross sectional view taken substantially along line 7—7 of FIG. 3.
FIG. 8 is a cross sectional view taken substantially along line 8—8 of FIG. 3.
FIG. 9 is a cross sectional view taken substantially along line 9—9 of FIG. 3.
FIG. 10 is a cross sectional view taken substantially along line 10—10 of FIG. 3.

Referring to the drawings a needle 10 is illustrated embodying the preferred form of the present invention. The needle incorporates a shank 12 at the uppermost portion adapted to be mounted in a needle bar or the like of a tufting machine. A blade portion 14 is connected to the shank and to a point portion 16 at its lower end. A needle eye 18 is illustrated as being wholly within the tapered point portion of the needle but may be within the lower part of the blade above the tapered point portion. Thus, the portion of the needle having the point and eye will be referred to as the eye and point portion. The blade portion 14 on one side includes a yarn guide groove 20 extending from the shank and terminating at the eye. Yarn Y is guided within the guide groove 20 and protected within the confines of the needle as it travels from a supply to the eye. The blade portion of the needle, as hereafter described, is formed with a clearance 22 known in the art as a clearance above the eye or C.A.E. within which a tufting machine looper 24 may be received on the downstroke of the needle after penetration of backing B as illustrated in FIG. 3. A recess 26 is beveled on an edge of the C.A.E. to provide additional clearance for the looper, which may actually contact the recess during the tufting process.

In accordance with the present invention the sides of the eye and point portion of the needle are constructed with very thin walls as illustrated in FIGS. 1 and 3. This has not been attainable with prior art constructions because in order to provide a sufficient clearance above the eye, the eye and point portion of the needle had to be thickened to provide a kick-out or step at the upper edge of the eye from which the blade was then reduced. The sides of the eye and point portion was thereby made wider than the blade. By use of the thickened eye and point portion, a reduction in the blade thickness above the kick-out provided the clearance. Since the blade could not be reduced in thickness to such an extent that it would fail after use for only a short period of time, the eye and point portion had to be made excessively thick.

In order to attain a needle with a thin eye and point portion and still provide the required C.A.E., the applicant has offset the eye and point portion of the needle parallel to the longitudinal axis of the needle, i.e., a center line 30 passing through the shank 12 in the direction of the plane of the eye 18, i.e., when viewed from the side, as illustrated in FIG. 3. The eye and point portion has a center line 32 which bisects the tip 34. Thus, the axis or center line 32 of the eye and point portion drawn through the tip 34 of the point is parallel to the longitudinal axis or center line 30 of the needle. Otherwise stated, the axis or center line 32 of the eye and point portion is offset parallel to the axis or center line 30. The direction of offset of the axis 32 is away from the side on which the groove 20 is formed. Moreover since the needle eye is in the plane of its axis 32, and since the plane of the needle axis is in the direction of backing fabric feed, the plane of the eye is offset relative to the needle axis 30. Thus, in the web portion of the blade above the eye as the edge of the blade is bent back toward the needle axis 30 a shoulder 36 is formed on the side toward which axis 32 is offset and the space above the shoulder is where the C.A.E. 22 is created. The blade in the entire region of the C.A.E. is also offset parallel to the axis 30 so as to form a throw-out or crank 38 toward the groove 20 side about and parallel to the axis 30. At the lower end of the crank 38 opposite the shoulder 36 the blade is deflected toward the longitudinal axis 30 to form a ramp 40 which merges into the eye and point portion to reduce friction between the needle and the backing. Moreover, at the upper end of the blade crank portion 38 a slight shoulder 42 forms a transition zone on the groove 20 side where the blade is deflected back toward the axis 30. A ramp 44 merges the groove 20 at the transition zone from the crank portion 38 into the remainder of the blade 14. The angle $\alpha$ made by the ramp 44 is smaller than the angle $\beta$ made by the ramp 40. Preferably $\alpha$ ranges from 3° to 6° while $\beta$ ranges from 12° to 15°.

The degree of offset of the eye and point portion and the distribution of mass of the needle may be further understood with reference to FIGS. 5 through 10, and particularly FIGS. 6 through 9. It can be clearly seen that the axis or center line 32 of the eye and point portion 16 is offset relative to the axis or center line 30 of the needle. The offset is such that the axis 32 passes through the clearance 22. The majority of the needle mass from just above the shoulder 36 to the tip 34 is to one side of the axis 30 while in the C.A.E. it is to the opposite side of the axis 30. The cross sectional area of the needle at the eye as illustrated in FIG. 8 when compared with the cross sectional area of a conventional needle of like gauge is substantially smaller. Thus, the penetration force of the new needle is substantially less.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. A needle for tufting or the like including a shank having a longitudinal axis, a blade extending from said shank, an eye and point portion including a transverse eye connected to said blade and terminating in a tip, said blade having a longitudinal groove on one side terminating at the eye, said eye and point portion having an axis parallel to and offset relative to said longitudinal axis away from said groove side, and means defining a shoulder at the junction of the eye and point portion with the blade on the side toward which the axis is offset to define a clearance above the eye.

2. A needle as recited in claim 1 wherein the axis of the eye and point portion passes through the clearance above the eye.

3. A needle as recited in claim 1 where said blade on the groove side adjacent said junction is deflected toward said longitudinal axis to define a ramp merging with the eye and point portion.

4. A needle as recited in claim 3 wherein the sides of said blade at the clearance above the eye is narrower than the remainder of the blade.

5. A needle as recited in claim 3 wherein the axis of the blade in the clearance above the eye is offset from said longitudinal axis toward the groove side of said blade.

6. A needle as recited in claim 5 wherein said axis of the blade is parallel to the longitudinal axis.

7. A needle as recited in claim 6 wherein the blade on the groove side in the clearance above the eye spaced from said ramp is deflected toward the longitudinal axis to define an upper offset angle with the longitudinal axis, said upper offset angle being less than the angle made by said ramp with said longitudinal axis.

* * * * *